US005507365A

United States Patent [19]

Prudhomme

[11] Patent Number: 5,507,365

[45] Date of Patent: Apr. 16, 1996

[54] UNIVERSAL LOCK FOR A POSITIVE SAFETY DOOR, IN PARTICULAR A LANDING ENTRANCE FOR ELEVATOR APPARATUSES

[76] Inventor: Dominique Prudhomme, 23, rue Robert Mousset, 75012 Paris, France

[21] Appl. No.: 130,524

[22] Filed: Oct. 1, 1993

[51] Int. Cl.[6] ..... B66B 13/02

[52] U.S. Cl. ..... 187/331; 187/280

[58] Field of Search ..... 187/331, 335, 187/280, 301; 49/116, 120, 122

[56] References Cited

U.S. PATENT DOCUMENTS 2,307,542 1/1943 Prince ..... 187/331

2,918,988 12/1959 Green ..... 187/331

3,277,979 10/1966 Stutz ..... 187/331

*Primary Examiner*—Kenneth Noland

*Attorney, Agent, or Firm*—Pollock, Vande Sande & Priddy

[57] ABSTRACT

The lock is of the type comprising: a housing that can be fastened to the door frame of the landing entrance, a locking bolt for the landing entrance, a bolt-control lever, an exterior lever-operating arm actuated by a cam in the elevator car, an electrical contact indicating the presence of the elevator car, a door pull-away electrical contact, a cable bushing device, and a housing attachment. These components are adaptable to many types of elevators, either by being reversible and/or by adaptation of spare parts supplied and arranged in a stand-by configuration in a recess in the housing.

37 Claims, 7 Drawing Sheets

UNIVERSAL LOCK FOR A POSITIVE SAFETY DOOR, IN PARTICULAR A LANDING ENTRANCE FOR ELEVATOR APPARATUSES

FIELD OF THE INVENTION

The present invention concerns a lock for positive safety doors and a double bolting configuration, in particular for landing entrances of elevators.

BACKGROUND OF THE INVENTION

In elevator equipment, it is essential that the landing entrances at any floor not open until the elevator car has arrived at that floor.

Similarly, it cannot receive the order to leave that floor until the landing entrance is closed, and closed correctly.

To this end, conventional practice encompasses the use of a positive safety lock with dual bolts, whose operation will now be described.

This type of conventional lock comprises:

a housing which can be attached to the door frame of a landing entrance;

a door-locking bolt arranged in a sliding configuration in the housing and acted upon by a compression spring, this bolt being capable of working in conjunction with a stationary striking pin attached to the leaf of a swinging or sliding door acting on a safety mechanism associated with the bolt and capable of allowing the total release of the locking bolt, provided that all of the parameters relating to the closing of the door are brought together;

a bolt-control lever linked to the bolt and actuated in a swinging motion around a pin, so as to cause the translational movement of the bolt during opening and closing;

a lever-operating arm acting directly on its axis in a position facing the housing, or by means of an angled retransmission system into a position to the side of the housing, this operating lever being mounted on the housing in such a way that it can be actuated in a frontal or lateral plane by a stationary or mobile cam fastened to an elevator car;

an electrical bolt contact ensuring closing only when the bolt is completely released in the locking configuration, and permitting, in this position only, the operation of the elevator;

secondarily, an electrical contact indicating the presence of the elevator car which closes the entrance when the operating arm is completely pushed back by the stationary or mobile cam attached to the car, and corresponding to an integral retraction of the bolt;

a pull-away electrical contact whose short-circuiting element is attached to the leaf of the door, so as to allow the operation of the elevator car cam only if the door is closed;

an electrical cable-bushing device for the cables emanating from the different electrical contacts;

means for attaching the housing.

This type of lock, widely used today in the sphere of application mentioned above, gives good results, but has the major disadvantage of requiring a very large range of models in order to address market requirements, based on all of the situations encountered.

Indeed, each of these cases calls for a special application for the lock, thereby engendering its specific design parameters.

By way of example, the most frequently-encountered cases include the following:

exit of the bolt to the right or left as a function of the direction in which the door opens;

the length of the different bolts, depending on the distance of the post of the door frame to which the lock is attached from the door;

the placement of the pull-away/presence contact to the right or left, or to the outside of the lock;

the positioning of the bevelled edge of the bolt as a function of the direction in which the door is opened and of the mode of operation, i.e., swinging, sliding, guillotine, etc;

the positioning of the control lever depending on whether the bolt is on the right or left;

the frontal, exterior, or lateral position of the operating arm as a function of the cam in the elevator car;

the position of the bolt and car-presence contacts.

It will easily be understood that this diversity of locks is very difficult to deal with, from both the manufacturing and the installation standpoints.

As regards installation, not only does the installer have to bear the excess cost arising from the limited production of each type of lock, but, moreover, the installer must keep a large inventory in order to be able to deal with immediate demand. This last point is also important from a financial perspective, since it entails a costly investment required for distribution of inventories difficult to control.

SUMMARY OF THE INVENTION

The present invention is intended to remedy all of these disadvantages by proposing a lock of the aforementioned type, and is characterized by the fact that at least one of the components of the lock comprises means capable of making it adaptable, whatever the situation encountered, so as to use a single housing to meet all market requirements.

Advantageously, all of the components are adaptable, whatever the situation encountered, either by being reversible on themselves and/or by means of the adaptation of specific spare parts which are supplied and arranged in a stand-by configuration in the housing, in a recess which is reserved for them, so as to make it universally applicable.

BRIEF DESCRIPTION OF THE DRAWINGS

The invention will be better understood, and other features thereof will emerge from the following description, provided with reference to the attached drawings illustrating, by way of example, how the invention can be implemented and in which.

DETAILED DESCRIPTION

Figure 1:
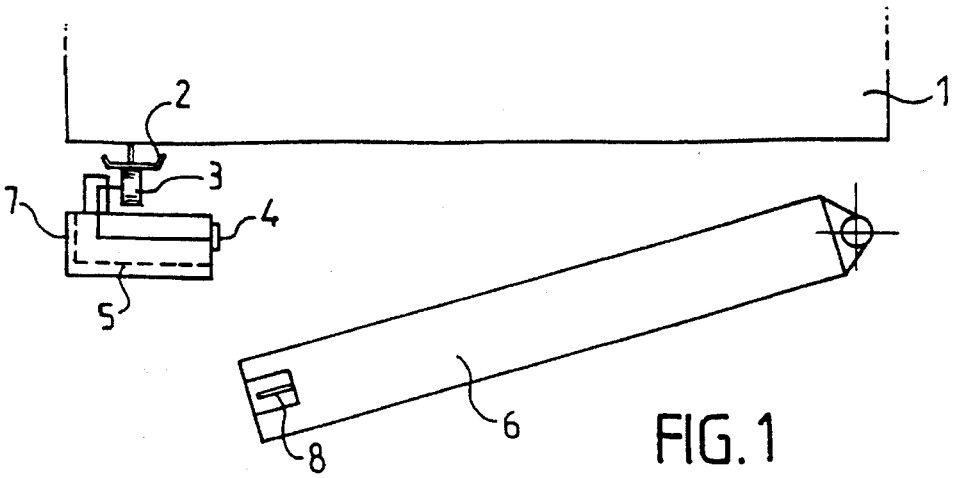
FIG. 1 illustrates schematically the operation of a safety device for a swinging landing door of an elevator, in the open position, according to the state of the art.
Figure 2:
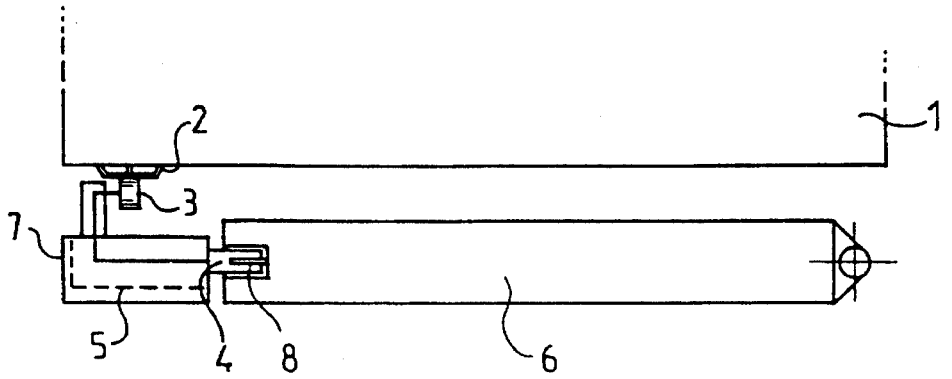
FIG. 2 illustrates schematically the operation of a safety mechanism for the swinging landing door of an elevator, in the closed position, according to the state of the art.
Figure 1A:
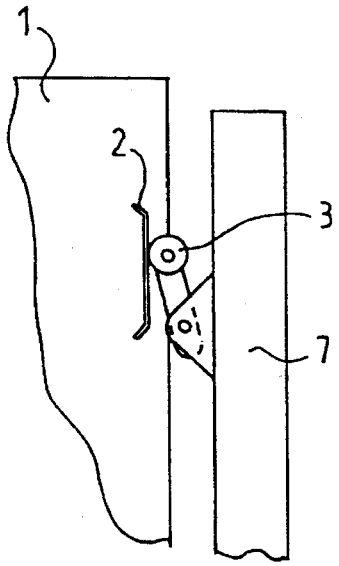
FIGS. 1A and 2A show, respectively, side views corresponding to FIGS. 1 and 2, i.e., with the door open and the closed.
Figure 2A:
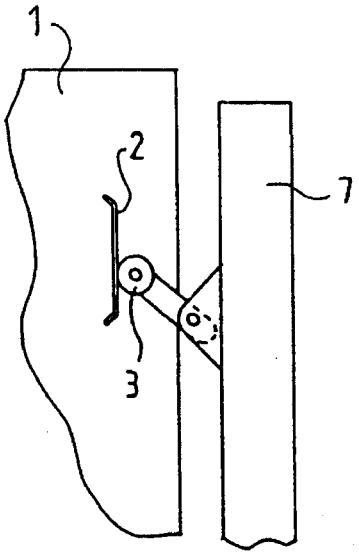

The conventional principle of operation underlying a safety device for an elevator landing door encompassed in preferred fashion, but not exclusively, by the invention, is as follows:

FIGS. 1, 1A and 2, 2A show that, when an elevator car 1 is at a floor, its control cam2 is extended and acts against a roller 3 which controls the opening of the bolt 4 of a conventional lock 5 arranged in a post 7 of the door frame. In this case, the landing door 6 can open.

When an order is emitted from the car 1, whether ascending or descending, that order can be carried out only if the door 6 is closed, and securely closed.

In fact, a striking pin 8 fastened to the door is arranged facing the bolt 4, so as to act on a mechanical safety device inside the bolt, in order to free it from its locked position.

If the bolt release is performed not at all or partially, an electrical bolt contact does not operate to close the door and the order cannot be carried out.

This principle of operation is known conventionally and, accordingly, will not be further described.

As a non-limiting example, the invention described below is applicable to an elevator whose cabin is fitted with a swinging door.

The universal lock 10, according to the invention, comprises a locking bolt 11 composed of a cylinder 11A capable of sliding in at least one bearing 12 of the housing 13 through which it extends. Cylinder 11A comprises a bore 11C extending completely through it and containing a core 11B, in relation to which said cylinder 11A can slide during its translational motion in a normal closing operation. The striking pin 8 then holds this core 11B in its initial position A so as to prevent the operation of a safety mechanism in the case of normal closing. In the event of abnormal closing, signalled by the non-presence of the striking pin (open door) and by its improper positioning (door poorly closed or lack of positioning of the lock), the core 11B, not being held in place or only partially held in place, then follows the movement of the cylinder 11A of the bolt 11 and trigger the safety mechanism.

Figure 3:
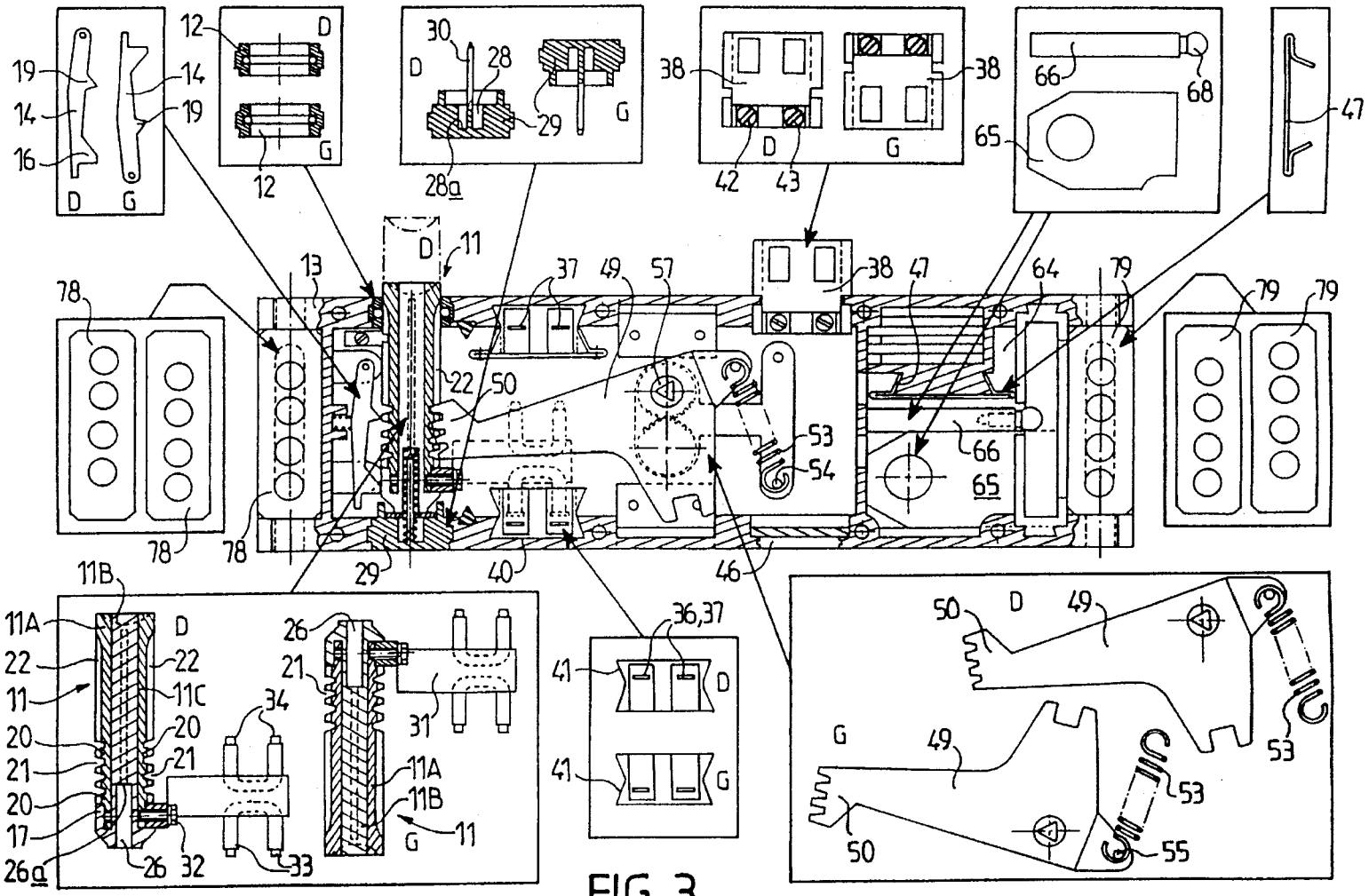
FIG. 3 is a general plane view of a universal lock according to the invention, shown without cover, with all adaptable components removed and are shown synoptically.
Figure 4:
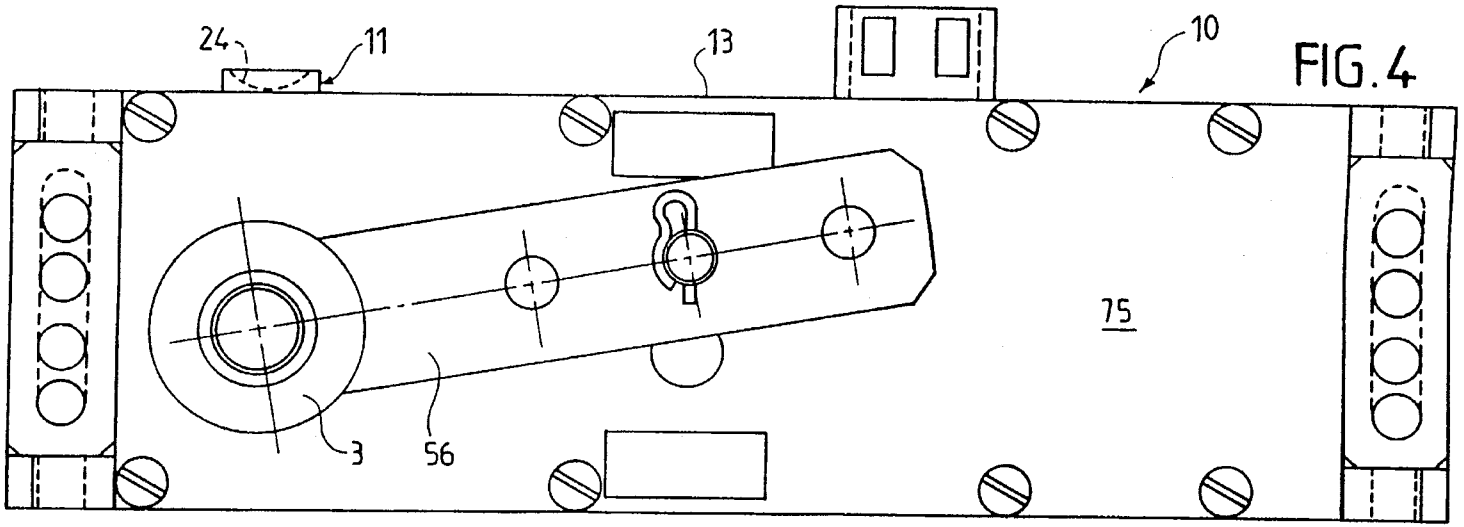
FIG. 4 is an overall plan view of a universal frontally-controlled lock according to FIG. 1, shown with its cover and exterior operating lever.
Figure 6:
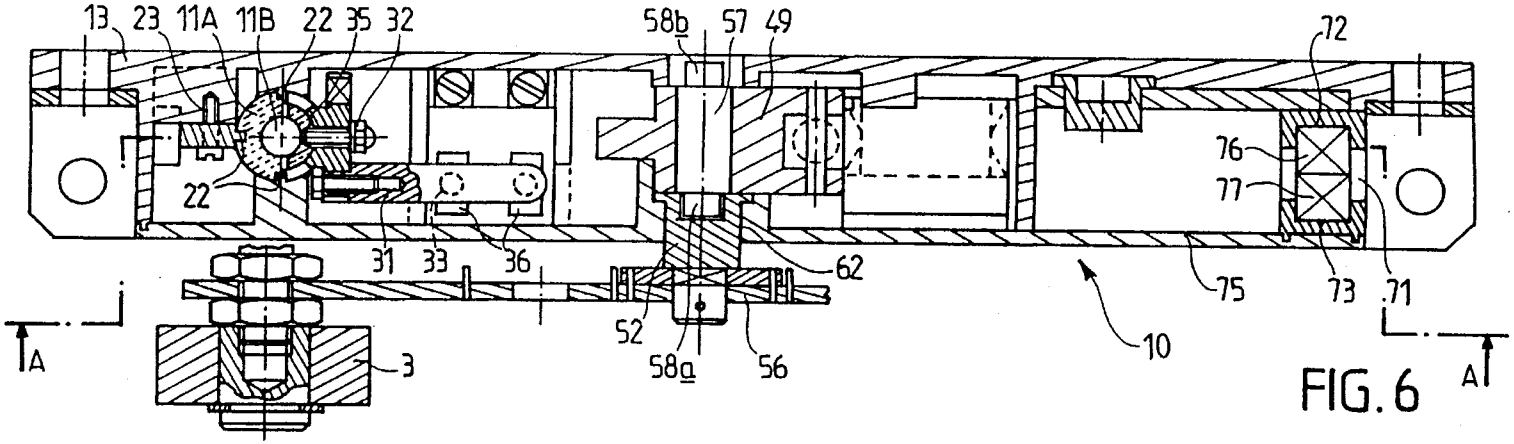
FIGS. 6, 7, 8, and 9 are cross-section views along lines B—B, C—C, D—D and E—E, respectively, in FIG. 5.
Figure 5:
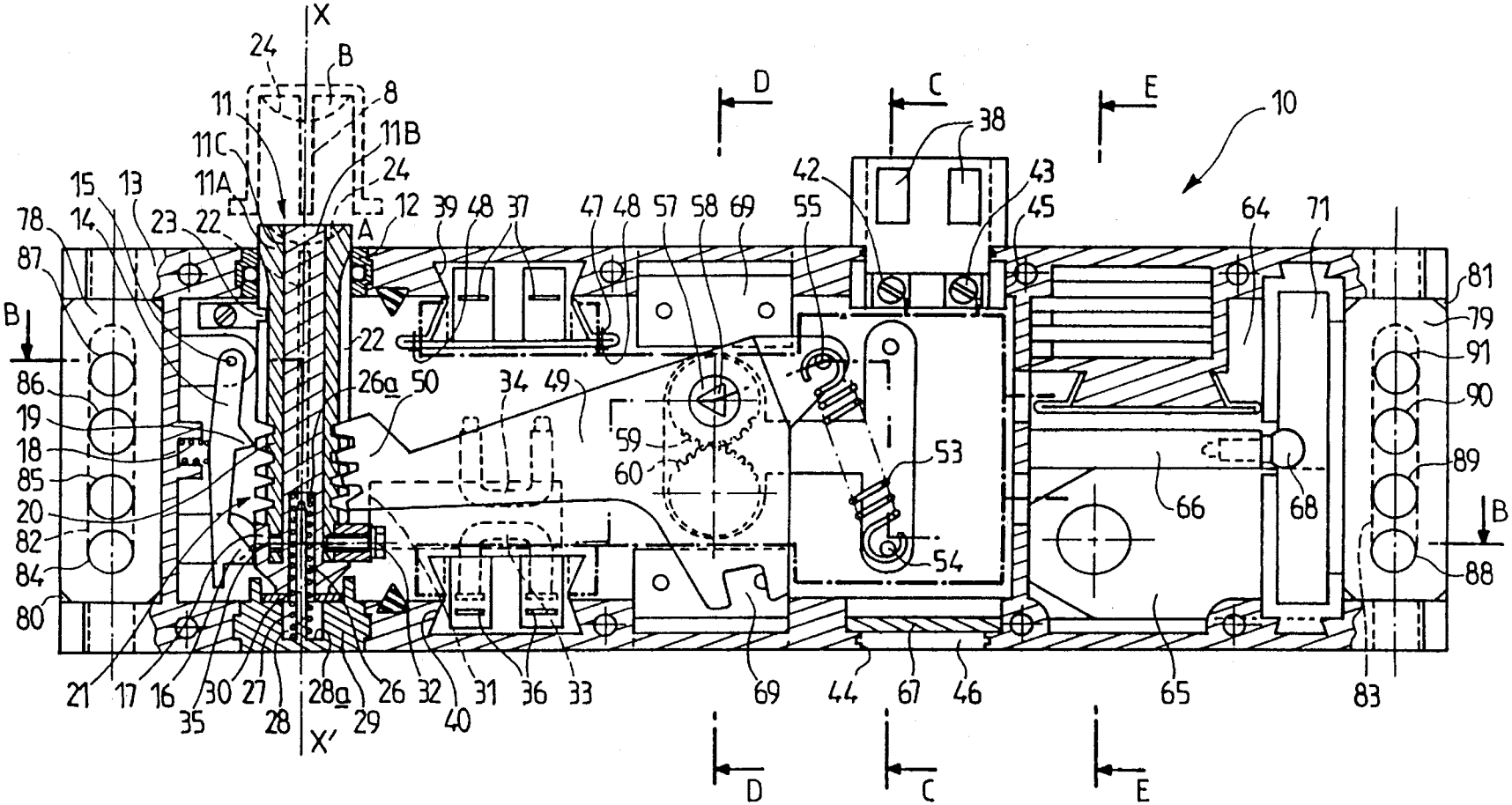
FIG. 5 is an overall plan view in longitudinal cross-section along line A—A in FIG. 6.
Figure 7:
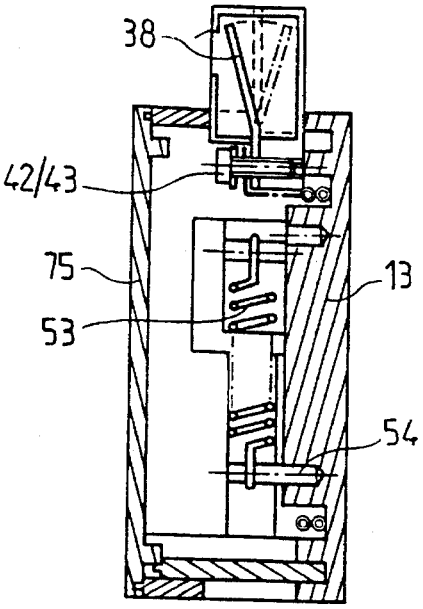

In FIG. 3, the letters D and G signify positioning of the corresponding component, to the right and to the left, respectively.

The safety mechanism consists of a ratchet 14 jointed around a stationary pin 15 associated with to the housing 13 and comprising, in its opposite part, a heel piece 16 resting on an exterior head 17 of the core 11B of the bolt 11, on which it exerts compression by means of a thrust spring 18.

The ratchet 14 comprises a locking pin 19 positioned between the heel piece 16 and the pin 15, which can work in conjunction with at least one corresponding tooth 20 of the cylinder 11A of the bolt 11, in order to hold it in position in the event of the release of the core 11B, thereby producing the release of the ratchet 14 and the freezing of the bolt 11 during its course of travel while closing.

In fact, the position-retention tooth 20 associated with cylinder 11A is delimited by a concentric groove 21 provided on the periphery of the cylinder, so as to permit any angled position around its longitudinal axis X—X'.

A multiplicity of concentric grooves 21 are produced on the cylinder 11A and spaced part by a distance corresponding to the stages of the closing of the bolt 11, in accordance with the safety standards in effect.

Moreover, the cylinder 11A of the bolt 11 comprises guide means 22 along at least one of its generating lines and cooperating with a stationary guide finger 23, which simultaneously guides the bolt 11 in translational motion and holds it in place while rotating around its axis X—X'.

In fact, the guide mechanism associated with the cylinder 11A of the bolt 11 comprises four guide grooves 22 which together form an angle of 90°, so as to allow the bolt to be oriented around its axis X—X' in four possible positions, as a function of the desired position of its end engagement bevel 24.

The guide means of the cylinder 11A of the bolt 11 may be formed from a flat member produced on a generating line of the bolt 11 and cooperating with a corresponding flat member of a mobile bearing 12 associated with the housing, this bearing having four exterior perpendicular sides making it movable in four different positions, so as to allow the bolt 11 to be positioned around its axis X—X' in four configurations as a function of the desired position of the end engagement bevel 24 of the bolt.

The core 11B of the bolt 11 comprises an axial obstructed recess 26 formed at the end opposite the end cooperating with the striking pin 8, a compression spring 27 being housed between the bottom 26*a* of this recess 26 and the bottom 28*a* of another obstructed recess 28 in a sealing plug 29 set opposite the bearing 12 in which the bolt 11 slides.

The sealing plug 29 and the bearing 12 of the bolt 11 are reversible and can be interchanged, depending on whether the bolt 11 is on the right or left side of the housing 13.

A pin 20, which guides the spring 27 and the core lib of the bolt 11, extends from the bottom of the obstructed recess 28 of the plug 29.

According to another feature of the invention, the end of the bolt cylinder 11A extending toward the outer head of its core 11B comprises movable means 32 for attachment of a movable dielectric support 31, on which two electrical linkages 33 and 34 are symmetrically positioned.

These means consist of a screw which passes through a portion of the movable support 31 and screws into one of the four threaded holes 35 drilled radially in the bolt cylinder 11A at an angled deviation of 90°.

According to a variant lower part of the movable dielectric support 31 comprises at least one transverse groove allowing it to slide on a corresponding track on the bottom of the housing and which is actuated directly by the control lever 49 freely housed in a U-shaped notch in movable dielectric support 31.

The electric linkages 33, 34 can short-circuit the electrical car-presence contact 36 in an unlocked position A of the bolt 11, as well as the electrical bolt contact 37 in a complete locked position 11 of the same bolt 11.

According to an inventive feature, the car-presence contact 36 and the contact 37 of the bolt 11 are arranged symmetrically on either side of the housing 13.

The lock also has a swinging door pull-away contact 38, which may be attached to a lateral wall of the housing 13, if desired.

According to an inventive feature, the car-presence contact 26, the contact 37 of the bolt 11, and the pull-away contact 38 are identical and incorporate attachment means which depend on the direction in which they are mounted.

In fact, the car-presence contact 36 and the contact 37 of the bolt 11 are attached directly in a recess 39 or 40 of the housing 13 by means of a slide-track system 41 forming a vertical dovetail, while the pull-away contact 38, identical to these parts, is mounted horizontally.

Of course, the dovetails may be replaced by any other arrangement.

In addition, the openings 44 and 45 for insertion of the pull-away contact are placed on either side of the housing 13, thus allowing the potential mounting of this contact on the housing, depending on whether the opening is on the right or left of the landing door 6, the unoccupied opening(s) being sealed with a movable cover 46.

According to another inventive feature, the cabin-presence contact 36 and the contact 37 of the bolt 11 are held in place by means of dovetailed pins 47 comprising attachment means 48.

The control lever 49 for bolt 11 incorporates, at one of its ends, a toothed sector 50 which forms a linkage with the concentric grooves 21, thereby ensuring not only the potential position-retention of the bolt 11 by means of the ratchet 14 associated with the safety mechanism, but also the anchoring of this toothed sector 50 of the control lever 49, in the manner of a rack. This arrangement ensures the transverse linear motion of the bolt 11 as a function of the angled pivoting of the lever 49 around an axis of rotation 52 of the housing 13 and against the force of a return spring 53 inserted between a stationary catch member 54 on the housing 13 and a rear part 55 of the control lever 49. The return spring may be arranged concentrically to the core 11B, between the head 17 of the core and an interior shoulder (not shown) formed in the bore 11C of the bolt 11.

The control lever is reversible, so that it can perform its function whatever the direction of operation of the bolt 11 in relation to the housing 13.

According to a further inventive feature, the bolt control lever 49 is linked to the outer operating arm 56 by means of a pin 57 comprising two actuation heads 58 constituted by male prisms having a triangular cross-section, of which one (**58*a*) cooperates with a corresponding recess housing an element of the arm 56, and the other (56*b*) remains free and is accessible from the extension of the housing and of the door frame, so as to permit possible manual unlocking of the bolt 11**.

Figure 8:
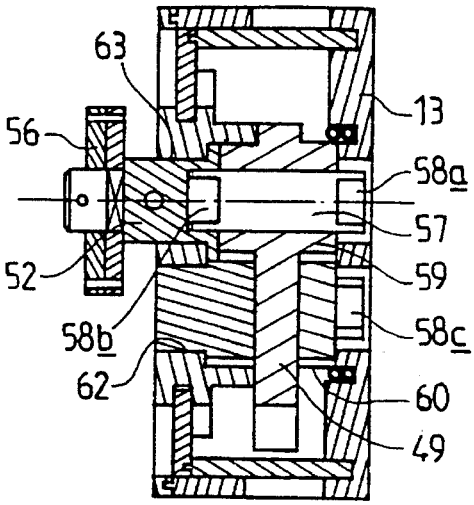
Figure 9:
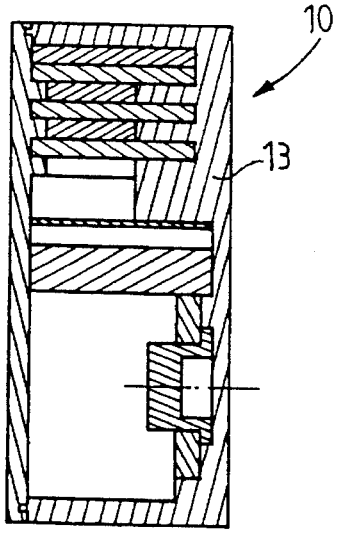
Figure 10:
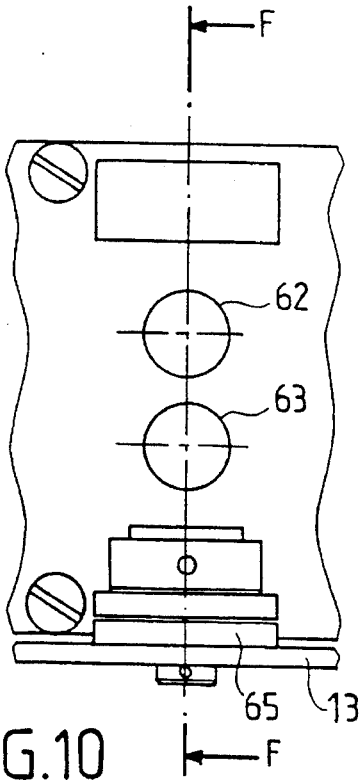
FIG. 10 is a partial plan view of a laterally-controlled lock operating perpendicularly to the housing.

As shown in FIG. 8, the manual operation may occur by means of another triangular head **58*c* attached to a pinion 60 directly engaged with a pinion 59 positioned on a hub of the arm 49. Accordingly, the lock can be manually released by acting on the triangles 58*a* or 58*c* in two positions of the lock 10** in the post of the door frame, through two holes drilled in the post.

This dual position of the lock 10 is also made possible by virtue of the fact that the bottom of the housing 13 incorporates two openings 62 and 63 designed to allow the passage, as desired, of the pin 52 of the actuation arm 56 toward the control lever 49, so as to permit two positions of the housing 13, which are selected as a function of the post of door frame, without modifying the length of the bolt 11.

Figure 11:
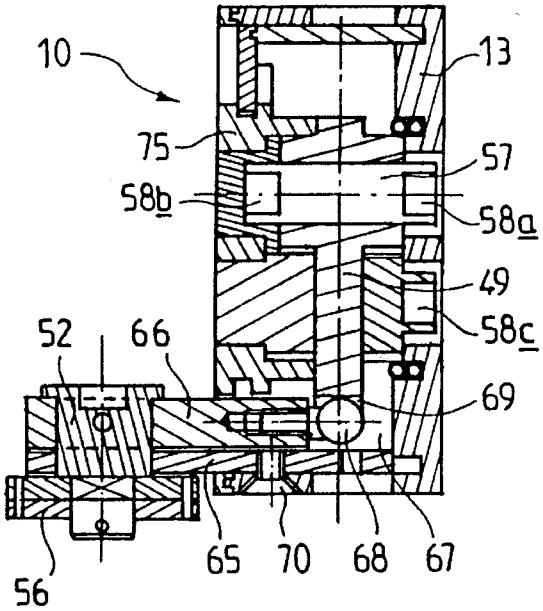
FIG. 11 is a view in cross-section along the line F—F in FIG. 10.

According to another feature of the invention, shown in FIG. 11, the set of spare parts supplied and placed on a stand-by basis in a recess 62 in the housing 13 include a return-motion part 65 positioned vertically, if needed, in a recess 67 in the housing 13, so that a rotating component 52 belonging to the operating arm 56 can extend through it perpendicularly, and on a pin 66 which passes radially through arm 56 and whose end forms a ball-joint 68 that can work in conjunction, in an actuation configuration, with a notch 69 cut in the control lever 49.

The recess 64 also comprises a location designed to keep in reserve a selection covers 46, for use according to the situations encountered.

Figure 13:
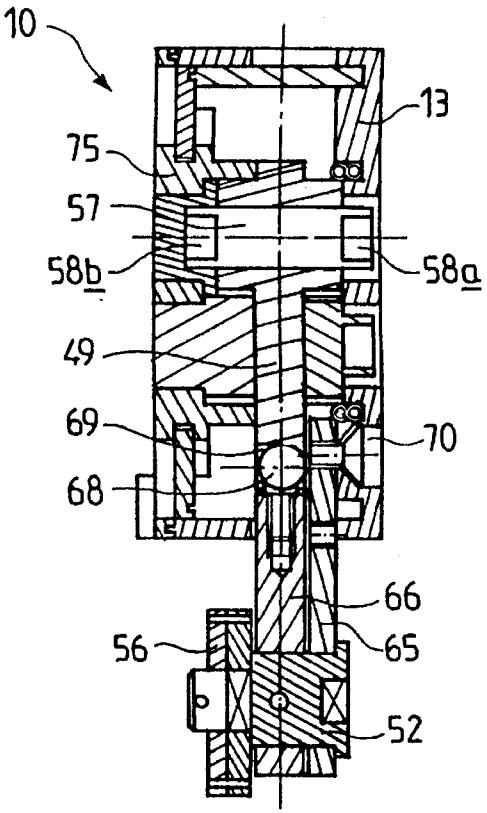
FIG. 13 is a view in cross-section along G—G in FIG. 12.
Figure 12:
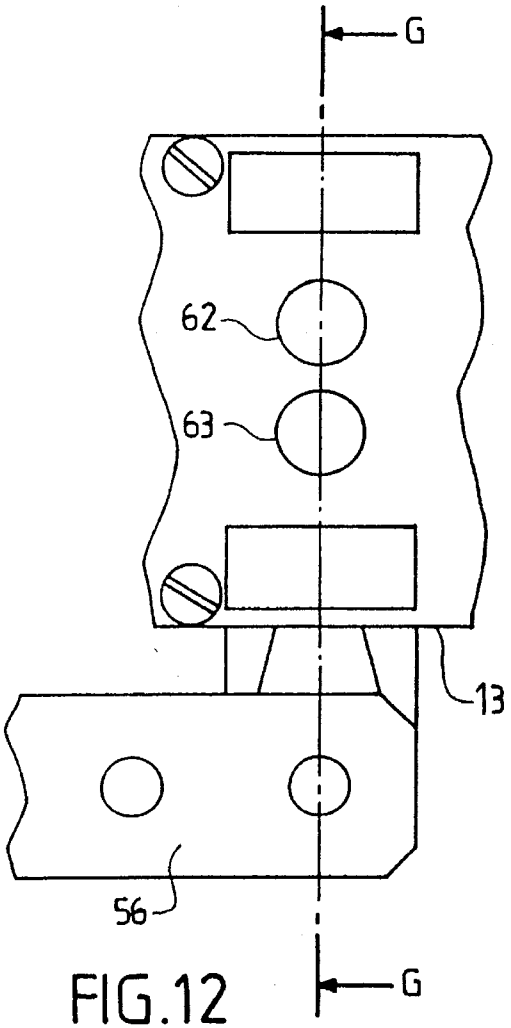
FIG. 12 is a partial plane view of an off-center laterally-controlled lock which operates parallel to the housing.

The embodiment shown in FIGS. 12 and 13 differs from that of FIG. 11 in that the arm 56 fitted with its pin 66 incorporating a ball-joint 68 is not perpendicular to the plane of the lever 49, but is located in its extension, so as to be applicable to a different situation.

In any case, the return-motion part 65 is held in the notch 67 of the housing by means of fastening screws 70. A notch 69 is provided on either side of the housing, so as to be able to reverse the arm 56, to the right or the left. In this case, the free notch will also be sealed with a cover 46.

According to another inventive feature, the cable-bushing device 71 comprises two transverse recesses 72, 73 arranged opposite each other, both in the housing and in the cover, and housing foam blocks 76, 77 capable of squeezing elastically, but without harming them, the electrical conductors leading from the contacts 36, 37, 38.

According to yet another feature of the invention, the housing 13 is attached in one of two positions, in relation to the width of the post of the door frame 7, by means of two small rigid plates 78, 79 mounted in corresponding recesses 80, 81 formed in the ends of the housing 13, the bottoms of these recesses comprising an oblong opening 82, 83, while the small plates 78, 80 are drilled with a multiplicity of holes 84 to 87 and 88 to 91, designed for the passage of fastening screws which attach the housing and which are chosen based on the position to be given to the housing 13 in relation to the post of the door frame.

The aforementioned holes, four per plate 78 and 79, are asymmetrical in pairs in relation to the transverse axis of the plate in question, so as to give different positions by its simple rotation around this axis.

Figure 14:
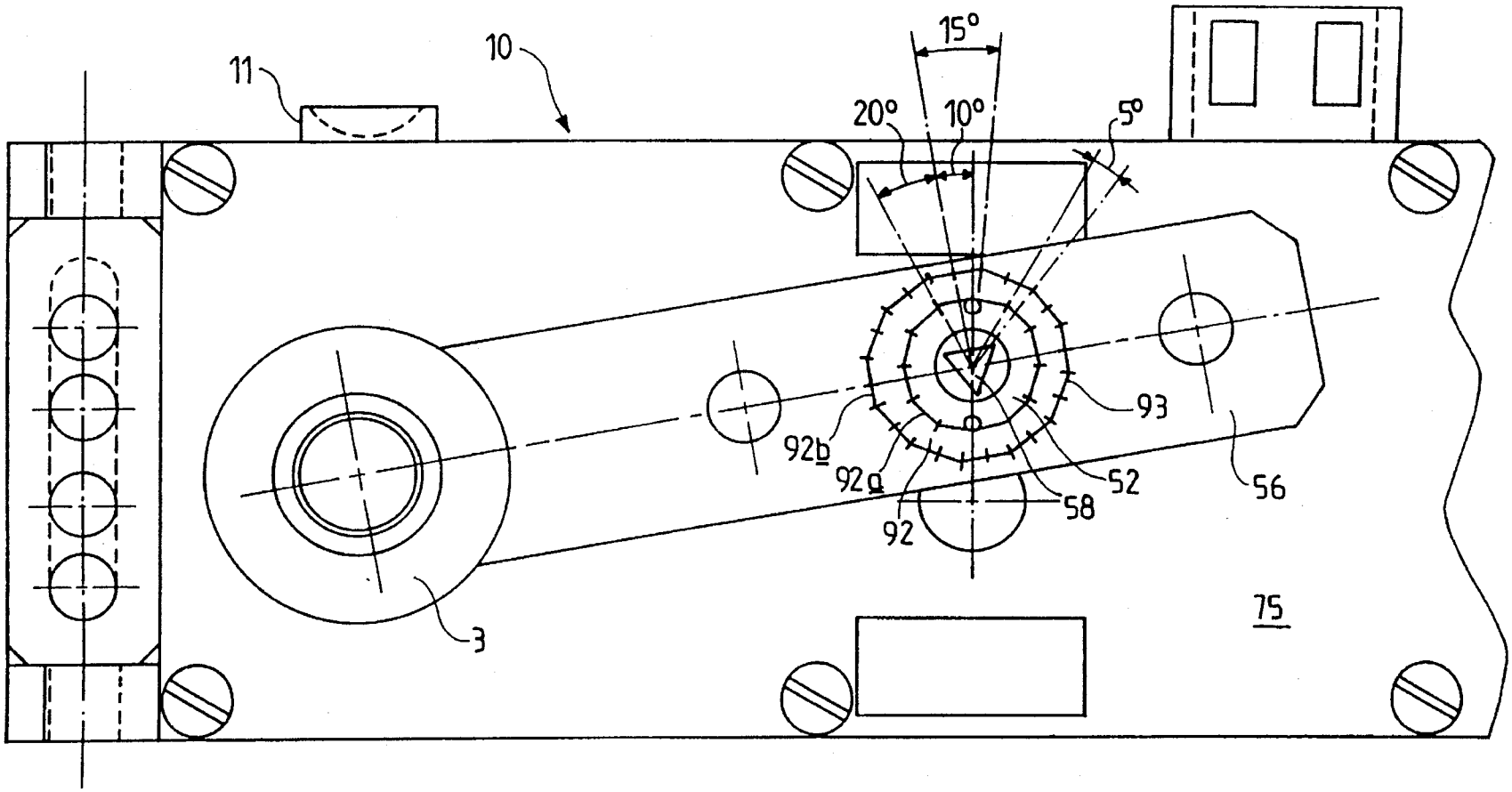
FIG. 14 is a plan view of a detail concerning the actuation and adjustment of an operating arm in relation to the control lever and to the housing.

According to a further inventive feature as shown in FIG. 14, the attachment of the operating arm 56 in relation to the control lever 49 occurs by means of angled adjustment means.

These means comprise a removable intermediate concentric ring 92 positioned between a bore 93 in the arm 56 and the pin 52 supporting the triangle attached to the control lever 49, the ring 92 being linked to the pin 52 by means of an entrainment dodecagon **92*a*, while the same ring is also linked to the arm 56 by a second entrainment dodecagon 92*b*, the two dodecagons 92*a* and 92*b* being concentric but offset by 5° one from the other, so as to produce a precise angular adjustment of the arm 56**.

Disengagement means may be interposed between the control lever 49 and the pin 52 supporting the triangle 58 attached to this lever 49.

Control lever 49 may comprise means for adjusting its functional length, these means including a rack working in conjunction with a position-freezing mechanism.

According to another inventive feature, the housing 13 is molded from a glass-filled polycarbonate. However, any other suitable material can be used.

All movable parts are preferably molded from a glass-filled polycarbonate, except for the electrical contacts, the return springs 27, 53, and the bolt 11, which must be made of brass.

Other materials can also be employed.

Finally, it is important to emphasize the fact that, because (a) bolt 11 can be positioned on the right or left by turning it around; (b) the housing 13 can be attached to the post of the door frame 7 in one of two positions; (c) the operating arm 56 can be set frontally or laterally, or offset laterally, in relation to the housing 13; (d) the pull-away contact can be mounted on the right or left, or omitted altogether; (e) the bolt 11 can adopt one of four angled positions around its axis X—X'; and (f) the control lever 49 is reversible to conform to a bolt placed on the right or left or up or down and controls in alternating fashion the bolt contact 37 and the car-presence contact 36, which are themselves reversible, the lock according to the invention can be adapted to all situations encountered using a single housing 13 enclosing components which are also single, by means of a cover 75 which holds all of the components in place.

I claim:

1. A lock for positive safety door and double bolting arrangement for landing entrances for elevators of the type comprising:

(a) a housing which can be attached to a door frame of a landing entrance;

(b) a door-locking bolt adapted to slide in said housing and acted upon by a compression spring, said bolt cooperating with a stationary striking pin attached to a leaf of a swinging or sliding door acting on a safety mechanism associated with said bolt and capable of allowing total release of said bolt when all parameters relating to closing of said door are brought together;

(c) a bolt-control lever linked to said bolt and actuated in a swinging motion around a pin, so as to cause translational motion of said bolt during opening and closing;

(d) a lever-operating arm acting directly on its axis in a position facing said housing, or, by means of an angled retransmission system, into a position laterally of said housing, said lever-operating arm being mounted on the casing in such a way that it can be actuated in a frontal or lateral plane by a stationary or movable cam fastened to an elevator car;

(e) an electrical bolt contact ensuring closing only when the bolt is completely released in the locking configuration, and permitting, in this position only, operation of the elevator;

(f) secondarily, an electrical contact indicating the presence of the elevator car, which closes the entrance when the operating arm is completely pushed back by the stationary or movable cam attached to said car, and corresponding to an integral retraction of the bolt;

(g) a pull-away electrical contact having a short-circuiting element attached to the leaf of the door, so as to allow operation of the elevator car cam only if said door is closed;

(h) an electrical cable-bushing device for cables emanating from the different electrical contacts;

(i) means for attaching the housing;

(j) wherein at least one of the components of said lock comprises means capable of adapting it universally using a single housing.

2. The lock according to claim 1, wherein all components can be adapted whatever the situation encountered, either by being reversiblé on themselves and/or by the adaptation of specific spare parts which are supplied and which are arranged on a stand-by basis in the housing, in a recess reserved for them, so as to make said lock universally applicable.

3. The lock according to claim 1, wherein the bolt is constituted by a cylinder capable of sliding in at least one bearing of the casing through which it extends, said cylinder comprising a bore extending comple. tely through it and which contains a core,in relation to which said cylinder can slide during its translational motion in normal closing operation, the striking pin then retaining said core in its initial position so as to prevent the operation of a safety mechanism in the case. of normal closing, while, in the event of abnormal closing signalled by the non-presence of the striking pin (open door) and by its improper positioning (door poorly closed or lack of positioning of the lock), the core being held in place at most partially, follows the movement of the cylinder of the bolt and triggers the safety mechanism.

4. The lock according to claim 3, wherein the safety mechanism consists of a ratchet jointed around a stationary pin belonging to the casing and comprising, in its opposite part, a heel piece resting on an exterior head of the core of the bolt, on which it exerts compression by means of a thrust spring; wherein said ratchet comprises a locking pin positioned between the heel piece and the pin and cooperating in conjunction with at least one corresponding tooth of the cylinder of the bolt, in order to hold it in position in the event of the release of the core, thereby producing the rel.ease of the ratchet and the freezing of the bolt during its course of travel while closing.

5. The lock according to claim 4, wherein said tooth providing for position-retention of said cylinder is delimited by at least one concentric groove on a periphery of said cylinder, so as to permit any angled position around its longitudinal axis.

6. The lock according to claim 5, comprising a plurality of concentric grooves at a distance one from the other in accordance with steps in the closing of said bolt.

7. The lock according to any one of claims 3 to 6, wherein said cylinder of said bolt comprises guide means provided on at least one of its generating lines and cooperating with a stationary guide device which ensures simultaneously the guidance of the bolt in translational motion and its position-retention as it rotates around its axis.

8. The lock according to claim 7, wherein the guide mechanism associated with the cylinder of the bolt comprises four guide grooves which together form an angle of 90°, so as to allow the bolt to be oriented around its axis in four possible positions, as a function of the desired position of its end engagement bevel.

9. The lock according to claim 7, wherein the guide means of the cylinder of the bolt are constituted by a flat member produced on a generating line of the bolt, which can work in conjunction with a corresponding flat member of a movable bearing belonging to the housing, said bearing having four exterior perpendicular sides making it movable in four different positions, so as to allow said bolt to be positioned around its axis in four configurations, as a function of the desired position of the end engagement bevel of the bolt.

10. The lock according to claim 3 or 4, wherein the core of the bolt comprises an axial obstructed recess formed a the end opposite that working in conjunction with the striking pin, and in which a compression spring is housed between the bottom of this recess and the bottom of another obstructed recess in a sealing plug set opposite said bearing in which said bolt slides.

11. The lock according to claim 10, wherein said sealing plug and said bearing of said bolt are reversible and can be substituted for each other, depending on whether said bolt is positioned on a right side or a left side of said housing.

12. The lock according to claim 10, wherein said obstructrid recess of the plug has a bottom which extends from a guide pin belonging to the spring and of the core of said bolt.

13. The lock according to claim 3, wherein the end of the cylinder of said bolt extending toward the outer head of its core comprises movable attachment means which fasten a movable dielectric support on which two electrical linkages are arranged symmetrically.

14. The lock according to claim 13, wherein said movable attachment means comprise a screw which passes through a portion of the movable dielectric support and which is screwed into one of the four threaded holes drilled radially in the cylinder of the bolt at an angular deviation of 90°.

15. The lock according to claim 1, wherein said lock comprises a movable dielectric support on which two electrical linkages are symmetrically arranged, said support having a lower part comprising at least one transverse groove capable of allowing it to slide on a corresponding track provided on the bottom of the housing, by direct actuation of said control lever freely housed in a U-shaped notch in said movable dielectric support.

16. The lock according to any one of claims 1, 3, 4 and 5, wherein said electrical linkages can short-circuit both the electrical presence contact in an unlocked position of the bolt, and the electrical bolt contact in a complete locked position of the same bolt.

17. The lock according to claim 16, wherein said presence contact and said bolt contact are symmetrically arranged on either side of said housing.

18. The lock according to claim 1, wherein said pull-away electrical contact can be attached to a lateral wall of the housing.

19. The lock according to claim 17 or 18, wherein said presence contact, the contact of the bolt, and said pull-away electrical contact are identical and comprise attachment means depending on the direction in which they are mounted.

20. The lock according to claim 19, wherein the attachment of said presence contact and said bolt contact is effected directly in a recess of said housing by means of a system of slide tracks having a vertical dovetail configuration, while said pull-away electrical contact, identical to the aforementioned contacts, is mounted horizontally.

21. The lock according to claim 20, comprising openings for insertion of said pull-away electrical contact on either side of the housing, so as to provide for possible mounting of said contact on the housing, as a function of the opening to the right or the left of the landing entrance, any unfilled opening being sealed by a movable cover.

22. The lock according to claim 20, wherein the presence contact and the bolt contact are held in place by means of dovetail-shaped pins comprising fastening means.

23. The lock according to any one of claims 1 to 6, wherein the bolt control lever incorporates, at one of its ends, a toothed sector which forms a linkage with the concentric grooves, which ensure not only the potential position-retention of the bolt by means of the ratchet belonging to the safety mechanism, but also anchoring of this toothed sector of the control lever, in the manner of a rack, in order to provide for transverse linear motion of the bolt as a function of an angled pivoting motion of the lever around an axis of rotation of the housing and against the force of a return spring.

24. The lock according to claim 23, wherein the control lever is reversible.

25. The lock according to claim 1, wherein the bolt control lever is linked to the outer operating arm by means of a in comprising two actuation heads constituted by first and second male prisms having a triangular cross-section, wherein said first prism cooperates with a corresponding recess housing an arm element, and said second prism (**58*b***) remains free and is accessible from the extension of the housing and of the door frame, so as to permit possible manual unlocking of the bolt.

26. The lock according to claim 23, wherein the bottom of the housing comprises two openings designed to allow the passage of the pin of the drive arm toward the control lever, so as to permit two positions of the housing, chosen as a function of the width of the post of the door frame, without modifying the length of the bolt.

27. The lock according to claim 2, comprising spare parts located on a stand-by basis in a recess in the housing and including a return-motion part positioned vertically, if needed, in a recess in the housing, so that a rotating component belonging to the operating arm can extend through it perpendicularly, and wherein a pin passes radially through said arm and has an end which forms a ball-joint cooperating in an actuation configuration with a notch in the control lever.

28. The lock according to claim 1, wherein the cable-bushing device comprises two transverse recesses which are located opposite each other both in the housing and in the cover, and which house blocks of a material capable of squeezing elastically the electrical conductors emanating from the contacts.

29. The lock according to claim 1, wherein the housing is attached in one of two positions in relation to the width of the post of the door frame by means of two small stiff plates mounted in corresponding recesses formed in the ends of the housing, bottoms of these recesses comprising an oblong opening, while the small plates are traversed by a plurality of holes for passage of fastening screws which attach the housing and which are chosen based on the position to be given to the housing in relation to the post of the door frame.

30. The lock according to claim 29, wherein the four holes drilled in the small fastening plates are asymmetrical in pairs in relation to the transverse axis of each plate, so as to permit different positions by rotating them around their respective axes.

31. The lock according to any one of claims 1, 24, 25 and 26, wherein the attachment of the operating arm in relation to the control lever is effected by means of a mechanism for adjusting each one angularly in relation to the other.

32. The lock according to claim 31, wherein said means comprise a movable intermediate concentric ring positioned between a bore in the arm and the pin supporting the triangle attached to the control lever, the ring being linked to the pin by means of an entrainment dodecagon, while the same ring is also linked to the arm by a second entrainment dodecagon, the two dodecagons being concentric but offset by 5° one from the other, so as to produce a fine angular adjustment of the arm.

33. The lock according to claim 32, comprising disengagement means interposed between the control lever and the pin supporting the triangle, which is attached to said lever.

34. The lock according to claim 1 or 32, wherein said control lever comprises a rack cooperating with a positionimmobilization mechanism for adjusting an operative length of said control lever.

35. The lock according to any one of claims 1 to 6, wherein said housing is molded from glass-filled polycarbonate.

36. The lock according to any one of claims 1 to 6, wherein all movable parts are molded from glass-filled polycarbonate, with the exception of the electrical contacts, the return springs, and the bolt, which are made of brass.

37. The lock according to any one of claims 1 to 6, wherein by virtue of the fact the bolt can be positioned on the right or left by turning it around, the housing can be attached to the post of the door frame in one of two positions, the operating arm can be set frontally or laterally, or offset laterally, in relation to the housing, the pull-away contact can be mounted with equal effectiveness on the right or left, or eliminated, the bolt can adopt one of four angled positions around its axis, and the control lever is reversible to conform to a bolt placed on the right or left or up or down and controls in alternating fashion the bolt contact and the presence contact, which are themselves reversible, whereby said lock can be adapted to all situations encountered by using a single housing enclosing components which are also single, by means of a cover which holds all of the components in place.

* * * * *

UNITED STATES PATENT AND TRADEMARK OFFICE

CERTIFICATE OF CORRECTION

PATENT NO. : 5,507,365

DATED : April 16, 1996

INVENTOR(S) : Dominique Prudhomme

It is certified that error appears in the above-indentified patent and that said Letters Patent is hereby corrected as shown below:

On the title page, insert item 30, "Foreign Application Priority Data";

--February 15, 1993 France .....93 01657--.

Signed and Sealed this

Twentieth Day of August, 1996

*Attest:*

Bruce Lehman

BRUCE LEHMAN

*Attesting Officer*

*Commissioner of Patents and Trademarks*